US008434800B1

(12) United States Patent
LeBlanc

(10) Patent No.: US 8,434,800 B1
(45) Date of Patent: May 7, 2013

(54) FLANGE LIFTER DEVICE

(76) Inventor: Adam LeBlanc, DeQuincy, LA (US)

( * ) Notice: Subject to any disclaimer, the term of this patent is extended or adjusted under 35 U.S.C. 154(b) by 0 days.

(21) Appl. No.: 13/419,097

(22) Filed: Mar. 13, 2012

Related U.S. Application Data

(63) Continuation-in-part of application No. 13/284,692, filed on Oct. 28, 2011.

(51) Int. Cl.
*B66C 1/28* (2006.01)
*B66C 1/62* (2006.01)

(52) U.S. Cl.
USPC ..... 294/82.1; 294/82.13; 294/106

(58) Field of Classification Search ..... 294/67.31, 294/81.56, 82.1, 82.13, 85, 106, 110.1, 118, 294/902
See application file for complete search history.

(56) References Cited

U.S. PATENT DOCUMENTS

| | | | | |
|---|---|---|---|---|
| 2,206,328 | A * | 7/1940 | Martinek | 294/85 |
| 2,819,111 | A * | 1/1958 | Cozzens | 294/26 |
| 3,164,406 | A * | 1/1965 | Barry | 294/199 |
| 3,207,463 | A * | 9/1965 | Downey | 248/339 |
| 3,337,256 | A * | 8/1967 | Shropshire, Jr. | 294/82.1 |
| 3,649,062 | A * | 3/1972 | Young, Jr. | 294/106 |
| 3,968,987 | A * | 7/1976 | Powell | 294/82.11 |
| 4,221,419 | A * | 9/1980 | Riley et al. | 294/106 |
| 4,530,536 | A | 7/1985 | Williams | |
| 5,064,334 | A | 11/1991 | Cooley | |
| 5,065,984 | A | 11/1991 | Hake | |
| 5,344,207 | A | 9/1994 | Grimm | |
| 5,842,729 | A | 12/1998 | Bunn | |
| 6,053,550 | A * | 4/2000 | Paterson | 294/81.56 |
| 6,581,996 | B1 * | 6/2003 | Fromelius | 294/89 |
| 6,609,742 | B1 * | 8/2003 | Macom et al. | 294/82.13 |

* cited by examiner

*Primary Examiner* — Dean Kramer
(74) *Attorney, Agent, or Firm* — Danel Boudwin

(57) ABSTRACT

A pipe flange lifting device for supporting and leveling a blind flange during installation onto a pipe end. The device comprises a pair of closed fittings having a plurality of apertures through which to place a first and second lifting bolt. The fittings are positioned on opposing sides of a pipe flange and rotate freely with respect to the pin prior to installation, whereafter the lifting bolts fitted through the flange and opposing fittings for stable support during operation. The lifting bolts comprise a pair of bolts inserted into eyes of the flange prior to the lifting operation. Spacers along the pin allow the fittings to be separated by a desired distance and prevent pinch points due to fitting inclination. The pin includes an attached crane hoist fitting for lifting the assembly and a secured flange during flange installation.

6 Claims, 1 Drawing Sheet

FLANGE LIFTER DEVICE

CROSS REFERENCE TO RELATED APPLICATION

This application is a Continuation in Part of U.S. patent application Ser. No. 13/284,692 filed on Oct. 28, 2011, entitled "Flange Lifter Device."

BACKGROUND OF THE INVENTION

1. Field of the Invention

The present invention relates to an improved means for lifting and rigging pipe flanges into position onto a pipe end. More specifically, the present invention pertains to a device for lifting medium to large pipe blind flanges into position for installation in a way that improves worker safety. The present invention eliminates the need to weld a lifting eye to the flange, saving time and resources and reducing the overall cost of installation of the flange.

2. Description of the Prior Art

Many industries utilize piping systems to facilitate daily operations. For example, oil refineries, gas companies and sewage treatment facilities need to pump and store large volumes of gases and/or liquids. The transport and storage systems for these products are large and are designed for durability and safety, as a leak in one of these piping systems could be extremely hazardous. Typically, piping systems are welded together at various junctions and joints to prevent against leaks. Piping systems may comprise an array of individual components and assemblies. The present invention pertains specifically to pipe blind flange fittings, wherein its design is specifically suited therefor. These fittings are very heavy components that require specific techniques and safety precautions when installing. Their sheer size and weight necessitates the use of a mechanical lifting device, such as a crane or mechanical hoist, during their lifting and rigging into place during installation.

Blind flanges are flat, disk-like covers that affix over the ends of open pipes. They are often difficult to lift and position because of their weight and their shape. A traditional procedure for lifting a flange involves welding a lifting eye onto the flange. The purpose of the lifting eye is to serve as a lift point for a crane hoist or other lifting apparatus, which is used to pick up the flange and suspend it while workers secure it to the pipe end assembly. The process is expensive and time consuming, as a worker must weld the lifting eye to the flange and then remove the lifting eye once the flange has been installed in the desired location. Another traditional procedure for lifting a flange involves inserting a chain through an eye of the flange and then using the chain to lift the flange. This method is highly hazardous to worker safety because any link of the chain could break and the flange could fall to the ground. These methods further do not provide the level of stability necessary for safe installation, as a chain or single lifting eye does not guarantee the device will not rotate while being positioned. This introduces a pinching risk for workers operating near the suspended flange and the pipe end, whereby clothing and limbs may be compressed therebetween if the flange is not statically supported. Worker safety and adequate precautions are paramount in such work environments and around construction sites, as accidents can lead to considerable injury to those involved.

There are many specialized devices that can facilitate the lifting of heavy industrial assembly components. For example, U.S. Pat. No. 4,530,536 to Williams describes a set of lifting tongs for use in conjunction with a crane for lifting I-beams. The device is designed for use by a single individual. The tongs are opened and closed by the operation of a pneumatic piston at the upper end of the set of tongs. A set of jaws exists at the lower ends of the tongs having a groove cut into the interior face of each jaw. The grooves are specifically designed to catch the edges of the top flange of an I-beam. A crane operator lowers the lifting tongs device around the sides of the beam that is to be lifted. The crane operator then operates the closing mechanism of the tongs. As the tongs close, the jaws come together to secure against the upper flange of the beam. The jaws are designed so that as the jaws are closing, if the crane operator slowly lifts the device with the crane hoist, the jaws catch the edges of the top flange of the beam within the jaw grooves.

The Williams device is particularly designed for the purpose of lifting I-beams. While the Williams device serves an important function by lifting such beams, the device could not be used for lifting blind flanges. The jaw and groove mechanism employed by the Williams device for catching the top edge flanges of an I-beam could not be used to grip the edges of a blind flange or support a pair of lifting bolts attached thereto, since the diameter of a blind flange is very likely to exceed the span of the top edge flanges of an I-beam and the tongs are not adapted to support the two bolts in a secure and stable manner.

U.S. Pat. No. 5,065,984 to Hake describes a clamp assembly device for lifting pins out of concrete forms. When concrete is poured, the outer edges of what is poured must be shaped into the desired form. A concrete form is typically a metal frame that is made from smaller segments of the form combined together to make the overall form of the concrete slab to be laid. The smaller portions of the frame fit together like puzzle pieces—connected to one another and held together via pins. The device attaches to a lifting mechanism, which can be a piece of industrial equipment that allows for an upward lifting element that facilitates lift needed when using the disclosed device. The lifting mechanism is important when using the Hake device properly as the pins must be removed from the concrete forms by pulling directly upward. Pulling the pins any direction other than vertically will damage the pin, the concrete form, or both. While suited for its particular requirement, the Hake device is limited to lifting concrete form pins. The present invention provides a lifting mechanism for use with a lifting mechanism, such as a crane or hoist, and is particularly suited for lifting pipe flanges into position for attachment onto a large pipe assembly or pipe end.

U.S. Pat. No. 5,344,207 to Grimm describes an apparatus for lifting tires that is used in conjunction with a lifting device, such as a crane. The device comprises two members for gripping a tire and a means for connecting to a crane. The first member is stationary, while the second member is movable. The second member has two positions: a tire lifting position and a tire non-lifting position. To use the device, a tire is placed between the two members when the second member of the device is in the non-lifting position. Once the tire is in properly placed in the device, the second member is moved by a user to the tire lifting position and locks into place so that the tire is gripped by the two members of the device.

Similar to the Grimm device is U.S. Pat. No. 5,064,334 to Cooley, wherein an apparatus for lifting large tractor tires is disclosed. The size of tractor tires makes them difficult to maneuver without the assistance of a lifting device. The Cooley device aims to lift and move tractor tires easily. When a tractor tire is standing upright on the tread, the Cooley device attaches to the tire by an attachment means. The tire attachment means connects to a boom, which is raised and lowered by a hand jack. The boom connects to a base and the boom is also capable of being pivotally rotatable to facilitate moving of the tractor tire from one point to another. One embodiment of the tire attachment means is a square-shaped clamp. The arms of the clamp extend around the sides of the tractor tire with the ends of the clamp arms wrapping under the rim of the tire so that when the clamp is closed around the tire, the tire is caught in the clamp. The boom can then be lifted, lifting the attached tractor tire with it by operating the hand jack.

Both the Grimm and Cooley devices are specifically suited for lifting tires. Each device employs a clamping mechanism is designed to grip, lift and suspend a tire. The clamping mechanisms of the Grimm and Cooley devices do not support the tire from below its structure in any way. The clamps merely pinch under the tire carcass such that the clamps encircle the sidewall and enter through the wheel opening. While it is unlikely, if the clamping mechanism of either the Grimm or Cooley devices were to fail, the tire would release or drop from the grip of the device. Such an accident could harm an individual or damage property. Not only is the present invention used for lifting blind flanges—and not tires—the present invention improves user safety in the event that the device where to fail. The fittings of the present invention are designed to catch a minimum or two lifting bolts inserted through eyes in a flange. Since the present invention further employs the use of two fittings and requires the fittings to catch a minimum of two lifting bolts during use, the safety redundancies incorporated into the present invention improve the overall safety involved with lifting heavy industrial products such as blind flanges.

U.S. Pat. No. 5,842,729 to Bunn describes a device for lifting large sections of heavy pipe. The device comprises a pair of lifting tongs that attach to a crane hoist or other lifting means. The tongs have two ends and are connected to each other at a pivot point. The bottom end of each tong curves inward towards the center of the tongs such that as the tongs close, they wrap around the cylindrical shape of the pipe cross section being moved. The top end of each tong connects to the other by a highly durable cable. The cable is looped through a lifting means, such as a crane hoist or a forklift. As the crane hoist or forklift rises, it pulls upward on the cable connecting the two top ends of the tongs, causing the top ends of the tongs to move towards one another. The tongs are positioned in a scissor configuration, wherein the cable action on the tongs compresses the working ends of the tongs around a pipe section. As the top ends of the tongs move towards each other, the bottom ends also compress towards each other, wrapping around the section of cylindrical piping. These tongs are not suited for adequately lifting or supporting lift bolts of a blind flange. The scissor action provides lateral compression but inadequate support under the flange bolts, which is necessary for safely and securely lifting a blind flange. The present invention provides a means to support a blind flange and lift bolts thereof in a secure and safety redundant manner.

The present invention provides a pair of rotatable, closed-end fittings that are rotatably connected and offset from one another via a common pin attachment. The fittings employ a plurality of apertures through which is adapted to be placed a pair of lifting bolts inserted through fastener locations on an industrial flange. The fittings are attached on either side of the flange and provide a support means that resists slippage or dislodgement of the flange during lifting and pipe end fitting operations. Spacers along the common pin provide the offset between fittings, and further prevent the fittings from binding or creating pinch points along the pin. It is submitted that the present invention substantially diverges in design elements from the prior art, and consequently it is clear that there is a need in the art for an improvement to existing flange lifting devices. In this regard, the instant invention substantially fulfills these needs.

SUMMARY OF THE INVENTION

In view of the foregoing disadvantages inherent in the known types of pipe flange lifting devices now present in the prior art, the present invention provides a new improved means of lifting and rigging pipe flanges wherein the same can be utilized for providing convenience and improved safety for workers during flange installation onto a pipe end.

It is therefore an object of the present invention to provide a new and improved lifting and rigging device for pipe flanges that has all of the advantages of the prior art and none of the disadvantages.

It is another object of the present invention is to provides a flange lifting device having a first and second closed-end fitting having a plurality of apertures and adapted to safely and securely lift and support lifting bolts of a pipe flange, wherein the assembly is attachable to a lift, hoist or crane.

Another object of the present invention to improve the overall safety for workers handling pipe flanges by providing a device that stably supports a suspended pipe flange prior to and during installation.

Another object of the present invention is to provide a safe method for lifting a large blind, and one that does not require the additional step of first welding a lifting eye onto the assembly.

Yet another object of the present invention is to provide a means of lifting and rigging blind flanges of various flange thickness and bolt pitch.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
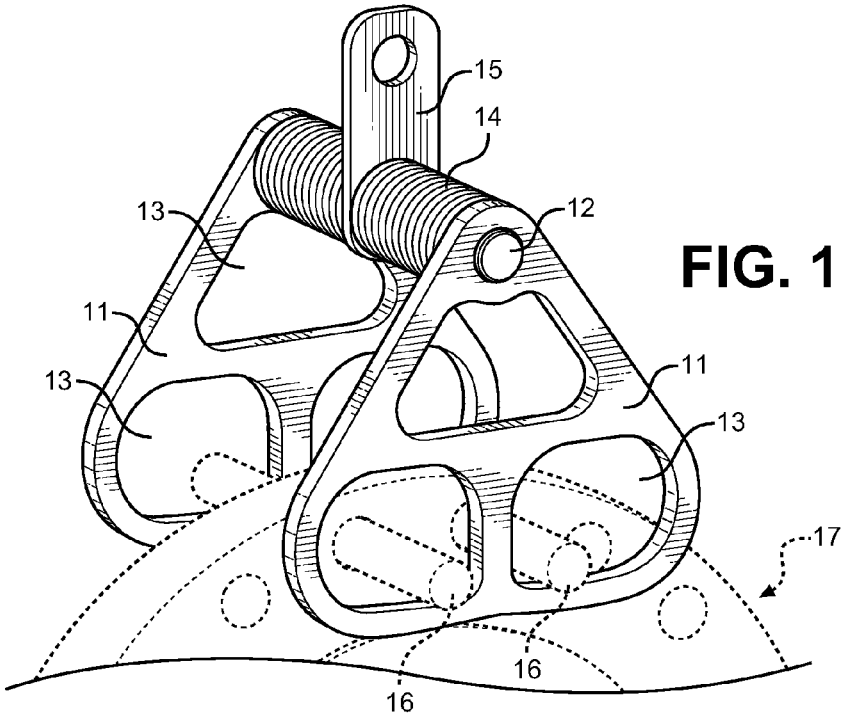
FIG. 1 is a frontal perspective view of the closed-end flange lifting device of the present invention.

Reference is made herein to the attached drawings. Like reference numerals are used throughout the drawings to depict like or similar elements of the pipe flange lifting device described as the present invention. For the purposes of presenting a brief and clear description of the present invention, the preferred embodiment will be discussed as used for lifting and rigging a blind flange into place onto a pipe end for fastening thereto. The figures are intended for representative purposes only and should not be considered to be limiting in any respect.

Referring now to FIG. 1, there is shown a frontal perspective view of the flange lifting device of the present invention in a working position and supporting an industrial flange 17. The flange lifting device comprises a first and second, closed-end fitting 11 having a plurality of apertures 13 disposed about their surface. The fittings 11 themselves are planar, structural members adapted to support the weight of the attached flange and allow for a pair of lifting bolts 16 to be positioned within an aperture 13. The fittings 11 are rotatably connected to a common pin 12, which positions the fittings 11 opposing one another and on either side of the flange 17 during operation. The offset between fittings 11 is provided by the gap therebetween along the pin 12, wherein a plurality of spacers 14 provide stable positioning along the pin length, and further prevent pinching or binding caused by inward or outward inclination of the fittings 11 along the pin 12. Along the pin 12 and preferably centrally mounted thereon is a crane hoist fitting 15 for attaching a crane, lift or similar lifting device thereto.

During operation, a flange 17 is prepped by placing a pair of lifting bolts 16 through two eyes along its periphery. The lifting pins 16 act as suspended support, wherein the pins 16 are fed through corresponding apertures 13 in opposing fittings 11. The fittings 11 can be rotated into position on either side of the flange 17, while the lifting bolts 16 can be moved relative to the fittings to allow the base of the fittings 11 to be placed under the lifting bolts for lifting operations. The closed-hole nature of the apertures prevents the lifting bolts 16 from sliding from one end of the fitting, while the use of a pair of lifting bolts 16 ensures stable lifting and positioning of the flange when fitting to a pipe end. A crane or similar lifting hoist is connected to the hoist fitting 15 to lift the present device and the connected flange, wherein the flange can be carefully maneuvered into position and secured to a pipe end. Once positioned on a pipe end, several bolts may be placed through the flange and into the pipe end, securing its positioning. Whereafter, the lifting bolts 16 are removed and the fittings 11 can be lifted away from the secured flange. The remaining open eyes of the flange may then be fitted with bolts and torqued into position.

The common pin 12 that connects the two fittings together allows the fittings 11 of the present device to rotate freely. Spacers 14 are utilized to prevent the fittings from rotating inward or outward, which otherwise would create pinch points or bind the device. The fittings 11 are prevented from sliding from the end of the pin 12 via a retaining clip or similar protrusion that expands the cross section of the pin 12 and can support the lateral load of the fitting 11 as it bears thereagainst. The interior ledges of each fitting aperture may be treated or coated with a non-marring, durable material such as high density rubber for the purpose of preventing damage to the threads of the lifting bolts while supporting the lifting bolts 16.

Figure 2:
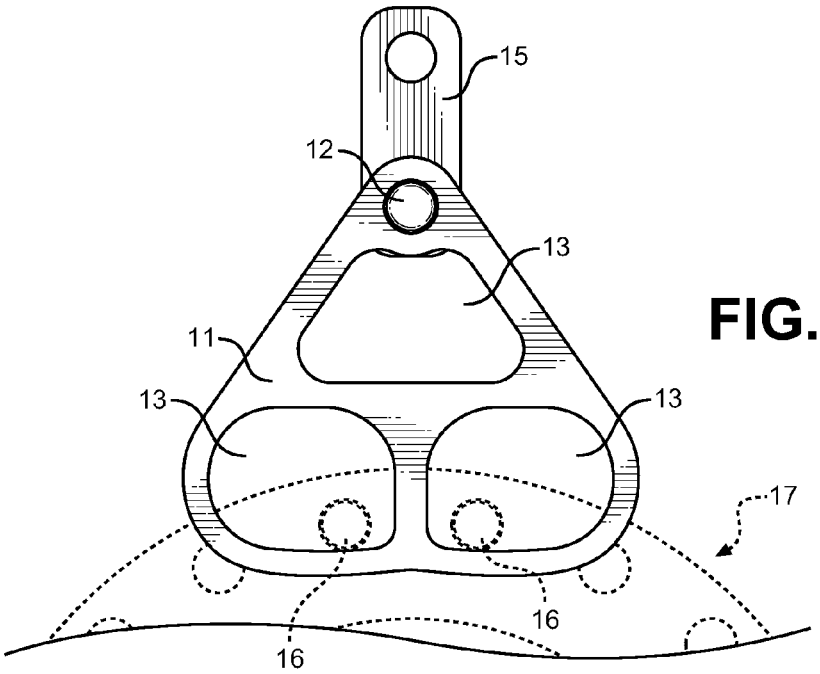
FIG. 2 is a front perspective view of the closed-end flange lifting device of the present invention.

Referring now to FIG. 2, there is shown side view of the present flange lifting device of the present invention in a working position. The lifting device employs a pair of fittings 11 having a plurality of support apertures 13, which are utilized to support a pair of lifting bolts 16 fed through the eyes of a blind flange 17. The apertures 13 are closed holes and provided in two segmented regions along the base of the fittings, along with an upper aperture centrally located along the upper portion of each fitting. This allows for different sized flanges 17 and wider or short eye holes to be accommodated, wherein the lifting bolts 16 can be positioned at various distances apart depending on the application. The upper aperture provides for closely located lifting bolts to fit into a common aperture, while the lower, split apertures place each lifting bolt 16 through its own support aperture. In either case, the lifting bolts 16 are supported on opposing sides of the flange 17 and in a stable configuration that prevents the flange from rotating or sliding within the fittings.

The shape of the fittings is ideally triangular to provide separated lower apertures and a single upper aperture. The thickness of the fitting and the edge distance between the flange edges and the apertures is sufficiently sized to accommodate its intended flange load, which can be considerable depending on application. The fittings support the lifting bolts as a crane or similar hoist lifts the assembly from the hoist point 15, whereafter it can be carefully controlled and positioned against a pipe end and attached thereto.

To use the device, an individual inserts, at the minimum, a pair of bolts into two eyes of a flange. The use of two bolts allows for distribution of the weight of the blind flange over a greater area and also provides a safety mechanism—if for some reason one of the bolts is fails during operation, the second bolt will likely hold until the blind flange can be set down onto the ground safely. The bolts are fed through the fittings of the lifting device and supported by opposing fittings. An individual positions the device such that a portion of the flange fits within the offset provided between the two fittings, using spacers to achieve minimal clearance between the flange surfaces and the fittings, while providing sufficient spacers to prevent pinch points due to fitting inclination. The assembly may be disassemblable to insert or remove spacers along the pin, or further to replace the pin for one of different length, and thus updating the offset between fittings. The user attaches a crane to the hoist point and lifts the assembly to place the flange weight onto the two lifting bolts, while that load is supported by the two fittings and transmitted to the crane hoist. The flange is then lifted and the lifting bolts are aligned with the receiving eyes of a pipe opening over which the flange is to be installed. Once the bolts align with the receiving holes, a user inserts additional bolts through the flange eyes and receiving eyes on the pipe opening before removing the device. The weight of the flange is then distributed among the installed bolts between the pipe end and the flange.

To remove the device, the crane hoist is lowered slightly, thereby relieving the fittings of the flange weight and allowing the user to remove the lifting bolts from the eyes of the flange. Since the flange is aligned with the target pipe opening and numerous bolts hold the two parts together, the device should no longer be bearing any of the weight from the blind flange. The user is then free to lift the crane hoist and remove the device from the flange such that the fittings clear the flange. The bolts can then be torqued into placed around the perimeter of the flange, which closes any clearance between the pipe end and the device necessary to fit the fittings during alignment.

While the embodiments of the present invention are specifically suited and intended to lift blind flanges, the present invention is not desired to be limited to lifting only such devices. The present invention may further be used to lift and rig a wide variety of other flange types, including, but not limited to, larger weld neck flanges, slip-on flanges, socket weld flanges, threaded flanges, lap joint flanges, ring joint flanges or tongue and groove flanges, presuming that the mechanism for lifting these other flange types can be safely facilitated by using the two bolt lifting point method described above.

The improved, triangular-shaped flange lifting device for lifting and rigging flanges during the fabrication improves user safety and facilitates the alignment of a blind flange with a pipe fitting, without requiring awkward fittings or hazardous methods that compromise safety and the effectiveness of the workers. The user is able to utilize the present device to align the flange and insert connecting fasteners while still attached to the disclosed fittings. The lifting bolts serve as lift points and, with the assistance of a lifting means, such as a crane hoist or forklift, the device assists positioning such flanges into place for installation on a pipe opening. The present invention further eliminates the need to weld a lifting eye onto the flange, which is a costly endeavor. Instead, the present invention allows for the flange to be lifted directly by the lifting bolts, which will then be used to secure the flange to the pipe opening. The closed apertures of the fittings further prevent the lifting bolts from sliding off of the fittings and creating a workplace hazard during installation.

In light of the foregoing prior art and the present disclosure, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe flange lifting device, comprising:

a set of opposing fittings separated by a given offset distance;

said fittings having a plurality of apertures therethrough adapted to provide a closed region having a ledge to support a lifting bolt;

said fittings rotatably attaching to a common pin spanning said offset distance;

said pin having a hoist fitting along its length for connecting said device to a lifting apparatus;

a plurality of spacers along said pin between said hoist fitting and said fittings to adjust said offset distance and prevent pinch points.

2. The device of claim 1, wherein said pin is separable from said fittings for the purpose of adding or removing said spacers or replacing said pin.

3. The device of claim 1, wherein fittings further comprise a generally triangular shape, having a pair of lower apertures and a singular upper aperture for supporting lifting bolts of varying pitch.

4. The device of claim 1, wherein said aperture support ledge is coated with a material to preventing damage to said lifting bolts during use.

5. The device of claim 4, wherein said material is a high density rubber.

6. A pipe flange lifting device, comprising:

a set of opposing fittings separated by a given offset distance and having a generally triangular shape, said fittings having a plurality of apertures therethrough adapted to provide a closed region having a ledge to supporting lifting bolts of varying pitch;

said plurality of apertures comprising a pair of lower apertures and a singular upper aperture;

said fittings rotatably attaching to a common pin spanning said offset distance;

said pin having a hoist fitting along its length for connecting said device to a lifting apparatus.

* * * * *